United States Patent [19]

Steinke

[11] 3,993,182

[45] Nov. 23, 1976

[54] ENDLESS INKED RIBBON CARTRIDGE

[75] Inventor: James Marion Steinke, Longwood, Fla.

[73] Assignee: TRW Inc., Los Angeles, Calif.

[22] Filed: Oct. 14, 1975

[21] Appl. No.: 622,223

[52] U.S. Cl. ..... 197/168; 197/151

[51] Int. Cl.[2] ..... B41J 33/10

[58] Field of Search ..... 197/151, 168; 101/336; 242/55.19 A, 197; 252/12

[56] References Cited

UNITED STATES PATENTS

| | | | |
|---|---|---|---|
| 764,342 | 7/1904 | Booth | 197/168 |
| 3,356,202 | 12/1967 | Goff | 197/151 |
| 3,490,671 | 1/1970 | Hladky | 197/168 UX |
| 3,758,012 | 9/1973 | Bonner et al. | 197/168 UX |
| 3,830,351 | 8/1974 | Cappotto | 197/168 |
| 3,871,507 | 3/1975 | Perry et al. | 197/168 X |
| 3,879,301 | 4/1975 | Cairns | 252/12 |
| 3,897,866 | 8/1975 | Mueller | 197/151 |
| 3,904,017 | 9/1975 | Frechette | 197/168 X |
| 3,918,569 | 11/1975 | Parker | 197/168 |

*Primary Examiner*—Edgar S. Burr
*Assistant Examiner*—Paul T. Sewell
*Attorney, Agent, or Firm*—Duckworth, Hobby, Orman, Allen & Pettis

[57] ABSTRACT

An endless inked ribbon printer cartridge for use in printing mechanisms for computer terminals, and the like, having a housing with a pair of protruding arms. A pair of spaced rollers are mounted in said housing and an endless inked ribbon wrapped around the rollers. The endless ribbon is fed from the rollers over a predetermined path between the arms. The spaced rollers have gear teeth formed therein and are connected by an idler gear therebetween so that they move together as the ribbon moves. Cartridge reliability is increased by the use of specific materials for the components along with a predetermined length of ribbon and predetermined inks impregnated in the ribbon.

10 Claims, 6 Drawing Figures

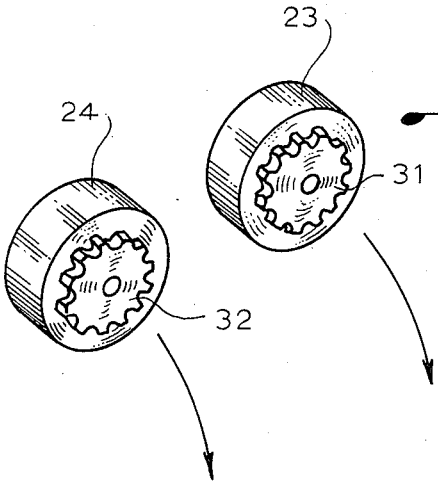
Fig. 2.
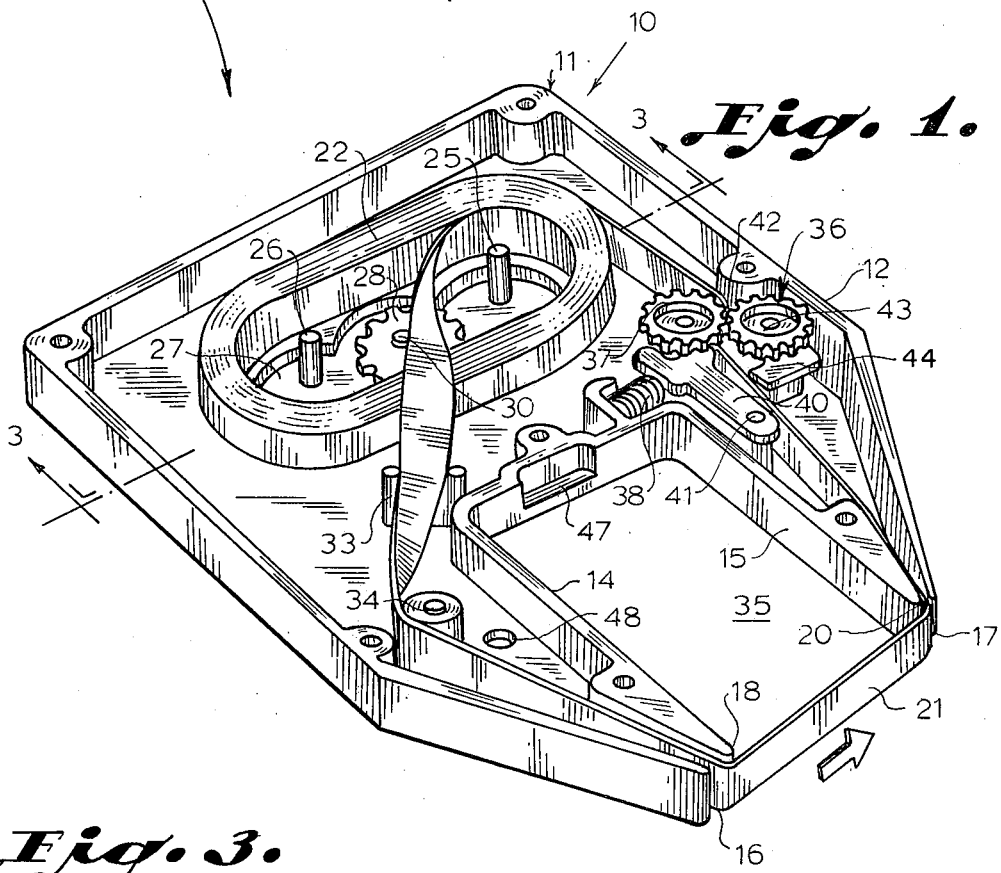
Fig. 1.
Fig. 3.
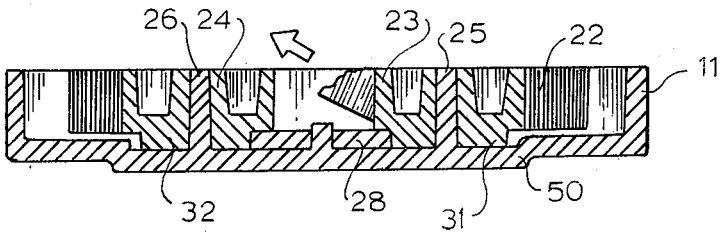

ENDLESS INKED RIBBON CARTRIDGE

BACKGROUND OF THE INVENTION

The present invention relates to ribbon cartridges and especially to a cartridge for an endless inked ribbon for printing mechanisms for use with computer terminals and the like. This patent is an improvement to the assignee's Patent Application for Endless Printer Ribbon Cartridge Apparatus, Ser. No. 451,951, now U.S. Pat. No. 3,918,569.

In the past a great many manufacturers have provided ribbon cartridges for use with their typewriters or printing mechanisms to replace the individually wrapped ribbons which must be individually threaded to the typewriter from a ribbon wrapped upon a spool to an empty spool. This in turn results in the operator's hands becoming smudged or messy during the replacement of a ribbon. Cartridge ribbons on the other hand may be connected from the wound spool to an empty spool and may be snapped in place with a minimum of inconvenience and time lost. A typical cartridge ribbon may operate with a pre-inked ribbon as well as with carbon ribbons which are destroyed once used or with ribbons that are continuously inked during the operation.

Typical prior art ribbon cartridges for typewriters or printer mechanisms may be seen in U.S. Pat. No. 3,621,968 for a ribbon cartridge with mobius loop in the ribbon which utilizes an endless ribbon through a serpentine path within a cartridge and uses a mobius loop configuration to effectively double the length of the ribbon and includes an ink pad mounted in contact with the ribbon for continuously inking the ribbon. A similar endless ribbon feeding mechanism may be seen in U.S. Pat. No. 2,755,905 in which an endless ribbon feeding device is adapted for shorthand typewriters and in U.S. Pat. No. 2,685,357 an endless ribbon feeding mechanism for typewriters is randomly looped inside a casing and fed out of the opposite end of the casing. Typewriter ribbon cartridges are also utilized for feeding from a full to an empty spool, such as illustrated in U.S. Pat. No. 3,731,781 for a Ribbon Supply Cartridge. Endless ribbon cartridges may also be seen in U.S. Pat. No. 3,726,381 and in U.S. Pat. No. 3,728,963. In addition, there have been cartridge feeding mechanisms utilized for prerecorded magnetic tapes feeding spools of plastic ribbon coated with an iron oxide or similar material past magnetic record and playback heads.

The present invention is an improvement over a previous endless printer ribbon cartridge apparatus and improves the prior cartridge to obtain an endless ribbon cartridge with higher reliability without substantially increasing the cost of the cartridge and teaches the use of specific materials for the components of the cartridge, as well as the physical characteristics of the ribbon and ink and an improved method of inducing motion to the ribbon.

SUMMARY OF THE INVENTION

This invention relates to an endless inked ribbon cartridge for use in printing mechanisms for computer terminals and the like. The cartridge has a housing having a pair of protruding arms with a pair of spaced rollers rotably mounted to the inside of the housing. An endless inked ribbon is partially wrapped around the spaced rollers for a predetermined plurality of turns so as to leave an open space between the rollers. The ribbon has a predetermined path coming off one roller between the rollers and is fed through one of the arms then between the arms into the other arm and back onto the outside of the partially wrapped ribbon. The drive mechanism for moving the ribbon is located in the housing for driving the ribbon over the predetermined path. Each of the spaced rollers has gear teeth therein which engage an idler gear rotably mounted to the housing between the gears which causes both rollers to roll simultaneously. A ribbon of predetermined length and number of wraps is provided using a predetermined ink to compensate for a continuous differential slip of the web in this type of ribbon cartridge and predetermined materials are used in the manufacture of the cartridge components to simplify fabrication and a new cartridge drive mechanism is provided.

BRIEF DESCRIPTION OF THE DRAWINGS

Other objects and features and advantages of this invention will be apparent from the written description and the drawings in which:

FIG. 1 is a perspective view of a cartridge in accordance with the present invention with the casing top and space rollers removed;

FIG. 2 is a perspective view of the spaced rollers;

FIG. 3 is a sectional view taken on the line 3—3 of FIG. 1;

DESCRIPTION OF THE PREFERRED EMBODIMENTS

Figure 4:
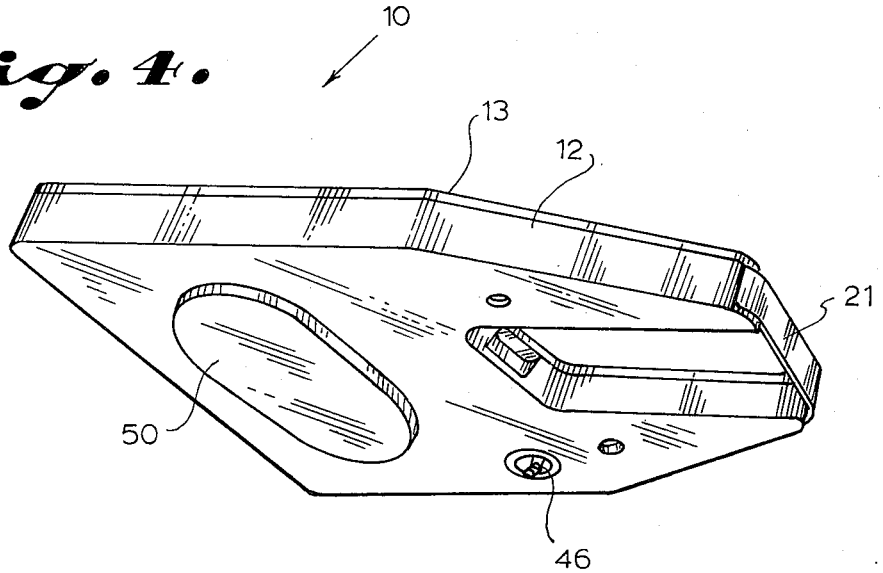
FIG. 4 is a perspective view of the bottom side of the ribbon cartridge in accordance with the present invention.
Figure 5:
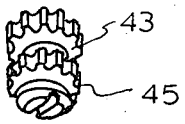
FIG. 5 is a perspective view of a portion of a cartridge ribbon engaging wheel.

Referring to FIGS. 1 through 4, a preferred embodiment of an endless ribbon cartridge 10 is illustrated having a casing or housing 11 including a main housing 12 with a cover 13. The housing 11 has a pair of protruding arms 14 and 15 having openings 16 and 17 respectively in the tips thereof. The opening 16 forms a guide 18 while the opening 17 forms a guide 20 for an endless ribbon 21. The endless ribbon 21 has a wrapped portion 22 wrapped around a pair of rollers 23 and 24 which are mounted on rotable shafts 25 and 26 molded into the casing base 12. The casing base 12 has a sunken portion 27 having an idler gear 28 rotably mounted on a shaft 30 formed in the casing base 12 for rotation thereon. Roller 23, may be an inking spool if desired, and has a gear portion 31 integrally formed therein while roller 24 has a gear portion 32 integrally formed therein so that rollers 23 and 24 gear portions 21 and 32 each engage the idler gear 28 with the gear portion 31 and 32 fitting into the sunken cavity 27. Thus, rollers 23 and 24 are always synchronized with each other so that when the endless ribbon 21 is being moved off of roller 23 and back onto the outside of the wrapped portion 22, roller 24 will move an identical amount through the idler 28. Ribbon 21 comes over the top of the wrapped portion 22 over a ribbon guide 33 onto a roller ribbon guide 34 and then through guide 18 across the space 35 between the protruding arms 14 and 15. The ribbon then passes through the opening 17 where it is engaged by a ribbon drive gear 36 on one side and is locked by an idle ribbon engaging gear 37, which is springloaded with a spring 38 pushing against a swinging arm 40 pin by pin 41. Gear 37 is offset which forces a bend 42 in the ribbon 21 as it passes therethrough. The gear 36 is mounted onto a shaft 43 which is mounted on a support 44 and has a matching bottom engaging gear 45 as illustrated in FIG. 5. Shaft 43 is connected through to a key portion 46 adapted to engage a driving mechanism for rotation of the shaft 43 and ribbon engaging gears 36 and 45. Similarly the gear 37 is a matching pair of gears on both sides of the arm 40 so that the drive mechanism firmly engages ribbon 21 between the gears 37 and 36 and 45 twisting the ribbon and assuring the absence of slippage during the shifting of the ribbon 21. Casing base 12 also has a lip 47 located on the exterior thereof between the arms 14 and 15 for attachment to the printing mechanism (not illustrated), as well as a pair of guide openings 48 for locating and positioning the cartridge correctly to the printing mechanism. In FIG. 4, the cavity 27 can be seen as a protruding portion 50 protruding from the bottom of the cartridge which can have a matching stop on the printing mechanism base for aligning the cartridge if desired.

Figure 6:
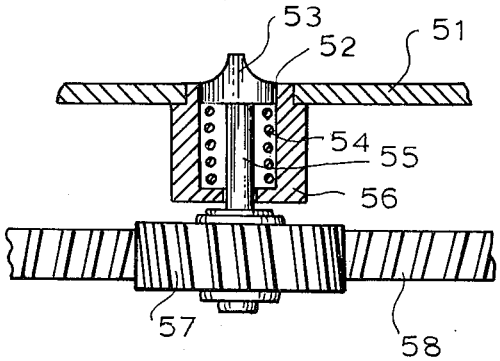
FIG. 6 is a front sectional view of the cartridge driving mechanism.

A portion of the printing mechanism is illustrated in FIG. 6 having a base 51 having an opening 52 therein with a protruding key 53 protruding therefrom and being springloaded with a spring 54. Key 53 is attached to a shaft 55 and rides in a casing 56 and is slideably connected to a gear 57. Gear 57 is keyed to the shaft 55 and is engaged by a rack 58 which may be a timing cog belt for driving the key 53 in a timed relationship with the operation of the printing mechanism and thus providing more accurate shifting of the ribbon 21 as each character is typed by the printing mechanism.

Previous ribbon cartridges used precision bearing spools with guiding flanges which were expensive to produce. To overcome this objection, the present cartridge is designed for fabrication by injection molding with the case 11 being molded of acetal resin filled with fibrous Teflon, such as Delrin AF, to integrally incorporate guide end bearing surfaces with a dry lubricant material having good abrasion and wear resistance. Thus, the other internal rotating parts are comprised of a suitably compatible but different plastic, such as polypropylene, to cooperate with the casing parts and surfaces of acetal to eliminate the attendant need for precise and expensive spool flanges and bearing surfaces. It should of course be clear that other combinations of differing plastics such as Delrin acetal for the case with Lexan (polycarbonate) used for the moving parts. A high density polyurethane for the moving parts could also be utilized.

Endless ribbon devices of the present type which reintroduce to the outside perimeter of a plurality of turns the ribbon which is extracted from the intermost turn must contend with a continuous differential slip of the web within the plurality of turns owing to the relative difference in the path lengths between the intermost and outermost turns. This differential slippage can result in reduced reliability of a cartridge if the frictional resistance becomes substantial. In a study of the reasons for failure and how to improve reliability, the importance of the relationship of the number of turns of the endless ribbon, along with its thickness and the length of web became important to insure reliable and satisfactory usage. Among the significant parameters affecting the power required to move the ribbon is the coefficient of friction of the ribbon both to itself and also to the stationary portions of the case that is in contact with, especially since the characteristics vary considerably between the static and dynamic modes of operation which may thereby give rise to erratic operation. Thus, the coupling between the supply spools by means of an idle gear and the use of solid lubricate type plastics connected to a different type of plastic enhances the operation of the ribbon. In addition, the study of the present cartridge found that with rollers having 0.625 inches diameter and with a ribbon of approximately 0.005 inches thick with an open loop of approximately 7 inches, with the hubs center span of 0.912 inches, 96 turns, with a ribbon length of 43 feet plus or minus ½ foot was desirable for increase reliability in the cartridge operation. This required measuring not only the number of turns of ribbon for each cartridge but also the footage of each cartridge be measured as it was applied to the cartridge.

It has also been found that the black inks currently used in printing ribbons increase the friction over that used in purple inks because this ink is more tacky. Thus, the present ribbon is provided with inks which do not increase the friction between the wrapped portions of the ribbon.

It should be clear at this point that an endless ribbon printer cartridge can be fabricated out of simple components of selected plastics and attachably latched and self-centering to a drive posts rotated unidirectionally by a flexible rack means utilizing a predetermined length of ribbon for a predetermined number of turns. It should however be clear that the present invention is not to be limited to the forms disclosed herein which are to be considered as illustrative rather than restrictive.

I claim:

1. An endless printer ribbon cartridge comprising in combination:

a housing having a pair of protruding arms;

a pair of spaced rollers rotatably attached to said housing;

an endless inked ribbon partially wrapped around said pair of spaced rollers for a plurality of turns so as to leave an open space between said rollers, said ribbon having a predetermined path coming off one roller between said pair of spaced rollers and being fed over said predetermined path back onto said partially wrapped portion of said ribbon;

drive means located in said housing for driving said ribbon over said predetermined path;

a gear portion attached to said spaced rollers and an idler gear rotatably attached to said housing between said rollers and operatively engaging each said gear portion of each roller whereby said rollers are synchronized; and said housing having a cavity extending into the bottom thereof with said rotatable idler gear rotatably attached therein and having the gear portion of said spaced rollers rotatably attached in said cavity.

2. The apparatus in accordance with claim 1 in which said gear portion attached to said spaced rollers are integrally formed in said rollers.

3. The apparatus in accordance with claim 1 in which said drive means has a pair of gears rotably mounted in said housing and a second pair of gears biased against said first pair for engaging said ribbon between said pairs for moving said ribbon over a predetermined path when said first pair of gears is rotated.

4. The apparatus in accordance with claim 2 in which said housing is made of one polymer material and said rollers and drive means gears are made of a second polymer material.

5. The apparatus in accordance with claim 4 in which said housing is made of acetal resin-filled with fibrous teflon and said rollers and drive means gears are formed of polypropylene.

6. The apparatus in accordance with claim 1 in which said endless inked ribbon is partially wrapped 96 turns on said pair of space rollers and is 43 feet, plus or minus ½ foot long.

7. The apparatus in accordance with claim 6 in which said endless inked ribbon is inked with an ink generating a low coefficient of friction between overlapping portions of said endless inked ribbon.

8. The apparatus in accordance with claim 1 in which a drive mechanism has a cog belt driving a geared shaft and said geared shaft has a key mounted on the end thereof for engaging said drive means for driving said inked ribbon in synchronization with a printing mechanism.

9. An endless printer ribbon cartridge and drive mechanism comprising in combination:

a housing having a pair of protruding arms;

a pair of spaced rollers rotatably attached to said housing;

an endless inked ribbon partially wrapped around said pair of spaced rollers for a plurality of turns so as to leave an open space between said rollers, said ribbon having a predetermined path coming off one roller between said pair of spaced rollers and being fed over said predetermined path back onto said partially wrapped portion of said ribbon;

drive means located in said housing for driving said ribbon over said predetermined path, said drive means having a first pair of gears attached to a shaft rotatably mounted in said housing and a second pair of gears rotatably mounted to a movable arm and biased against said first pair of gears, said second pair of gears being mounted offset to partially wrap said ribbon on said first pair of gears for moving said ribbon over a predetermined path when said first pair of gears is rotated; and a drive mechanism having a cog belt driving a geared shaft and said geared shaft having a key mounted on the end thereof for engaging a key-way connected to the shaft of said drive means for driving said first pair of drive means rotatable gears and thereby moving said inked ribbon in synchronization with a printing mechanism.

10. The apparatus in accordance with claim 9 in which said second pair of gears are mounted on said movable arm and said movable arm is pinned to said housing and has a spring biasing said arm and second pair of gears toward said first pair of gears.

* * * * *